United States Patent [19]

Hoinski

[11] 4,284,980

[45] Aug. 18, 1981

[54] DOOR BURGLAR ALARM SYSTEM

[75] Inventor: Walter W. Hoinski, Norristown, Pa.

[73] Assignee: Power Systems Development Corporation, Wilmington, Del.

[21] Appl. No.: 898,421

[22] Filed: Apr. 20, 1978

[51] Int. Cl.[3] ..... G08B 13/08

[52] U.S. Cl. ..... 340/545; 340/541; 340/542; 200/61.64; 200/61.67; 116/86; 49/13; 160/10

[58] Field of Search ..... 340/545, 540, 541, 546; 200/61.62, 61.64, 61.67, 61.68, 61.69, 61.71, 61.72, 61.73, 61.81, 61.82; 116/75, 85, 86; 49/13, 14; 160/10; 232/35, 36, 37

[56] References Cited

U.S. PATENT DOCUMENTS

| | | | |
|---|---|---|---|
| 487,128 | 11/1892 | Reynolds | 200/61.81 |
| 700,652 | 5/1902 | Janke | 200/61.81 |
| 1,562,589 | 11/1925 | Replogle | 200/61.62 |
| 2,691,357 | 10/1954 | Owen | 116/87 |
| 3,312,968 | 4/1967 | Kiefer | 200/61.62 |
| 3,541,276 | 11/1970 | Lea | 200/61.62 |
| 3,727,210 | 4/1973 | Hawkins | 340/542 |
| 3,798,627 | 3/1974 | Kaufman | 200/61.62 |
| 3,968,337 | 7/1976 | Cole | 200/61.62 |
| 4,123,752 | 10/1978 | Novotny | 340/545 |

*Primary Examiner*—John W. Caldwell, Sr.
*Assistant Examiner*—Donnie L. Crosland
*Attorney, Agent, or Firm*—Paul & Paul

[57] ABSTRACT

A door burglar alarm system having, preferably, a door movement intercepting component which may be moved easily in the direction of door movement by an opening motion of a door and which may be connected to a trigger mechanism to initiate an alarm signal in response to a predetermined distance having been traversed by the intercepting component, this intercepting component whereupon may provide a positive resistance prohibiting the further movement thereof in the direction of opening the door whereby the door is also prohibited from opening further.

10 Claims, 8 Drawing Figures

DOOR BURGLAR ALARM SYSTEM

BACKGROUND OF THE INVENTION

This invention relates to door burglar alarm systems, and more specifically relates to such systems activated or tripped by the opening motion of a door or a window.

These apparatus have been implemented by alarm systems primarily concerned with utilizing the opening of a door or window to trip a limit switch as the door or window exceeds a given limit point, whereupon an alarm signal is initiated. Such apparatus have always permitted the door or window to be opened beyond the limit point.

Many such door alarm systems have utilized cables, chains or ropes, connected between a point on the door and an alarm activation mechanism, typically, a switch control for a bell, via a pulley or guide system. Other door alarm systems have utilized a pivotal rod or hinge switch to activate an alarm. In each instance the alarm activation mechanism has permitted a complete opening of the door. The activation mechanism, whether it involved a chain or cord, a pivotal or hinged activation mechanism, or a rotating activation mechanism, has required a substantial amount of movement by the door to activate the alarm. Of necessity there has been a certain amount of "slack" or "play" designed into these systems. Such "play" was intended to compensate for the imprecise structural configuration of such systems in order to eliminate the false tripping of the alarm. "Play" was a tolerable evil necessitated by the stretching of a cable or a cord or a wearing or change in pivotal friction of a mechanical pivot trip switch.

Systems which tolerate more than a slight opening of a door provide an opportunity for detection of the existence of the burglar alarm which in turn provides the burglar with an opportunity to disarm such a system. Moreover, such systems, by the very nature of their design, exert a certain resistance to the opening of the door which resistance if detected can alert a burglar to the presence of an alarm system.

Many door alarm systems are unsightly and involve a large amount of hardware which is needed to be mounted on the interior surface of a door or on interior walls.

An object of this invention is to provide a door burglar alarm which is mountable to the door jamb and which offers no substantial resistance to the opening of the door.

A second object of this invention is to provide such an alarm which will prohibit the door from being opened beyond a certain distance.

A third object of this invention is to provide this alarm where the amount of opening can be regulated to be less than the width of the door jamb.

A further object of this invention is to provide this alarm with an activator which is movable in a plane tangent to the opening arc of the door, said plane of tangential movement by the activator providing a minimal resistance to door swing.

An even further object of this invention is to provide such an alarm having but a single mounting bracket wherein nothing is mounted to the door directly.

SUMMARY OF THE INVENTION

The objects of this invention are realized in a burglar alarm system for a door which may be mounted to the door jamb and which may be activated by the movement of a rod or bolt slidably placed in the path of opening movement of the door.

This rod or bolt may be moved with minimal resistance or friction by an opening motion of the door in a plane tangent to the swing arc of the door until an electrical contact is closed to activate an audible alarm.

A permanent stop may be positioned in proximity to the location of the electrical contact for prohibiting further movement of the door whereby the rod or bolt may then operate as a positive door stop.

DESCRIPTION OF THE DRAWINGS

The detailed features, advantages and operation of the invention can easily be understood from a reading of the following detailed description of the invention in conjunction with accompanying drawings wherein like numerals refer to like elements and in which.

DETAILED DESCRIPTION OF THE INVENTION

Figure 1:
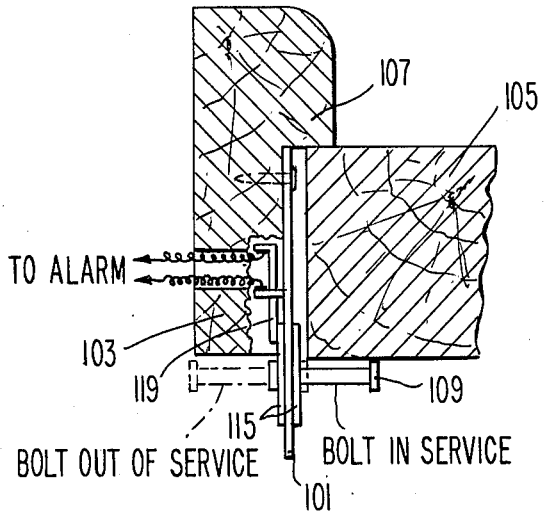
FIG. 1 shows the new construction installation of the invention.

A burglar alarm system for detecting when a door has been jimmied and partially opened includes a support bracket 101 capable of being attached to a door jamb 103. The thickness of this base support bracket 101 is such that it will permit a door 105 to close normally against the door stop 107 portion of the jamb 103, however, this base support bracket 101 is wide enough to provide a stable mounting surface.

A bolt 109 is slidably positioned to an out-of-service position or an in-service position, the latter position being wherein the bolt 109 intercepts the arc swing of an opening door 105.

Figure 2:
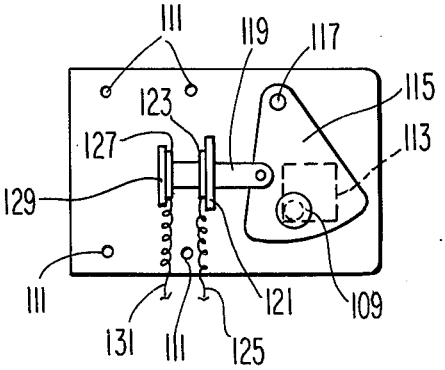
FIG. 2 is a side view of the invention showing the support brackets and associated apparatus for the new construction installation of FIG. 1.

The base support bracket 101, FIG. 2, may be essentially rectangular having at least four identical holes 111 drilled therethrough at one end of the bracket 101 for mounting this bracket to the door jamb 103. Located in the support bracket 101 at the end opposite the holes 111 is a cutout opening or limit opening 113 which may have approximately a rectangular shape. This limit opening 113 establishes the limits of movement for the bolt 109.

An egg-shaped or pear-shaped flat swivel plate 115 is pinned to either side of the support bracket 101 opposite the door 105 side thereof by a pin 117 through the pair of swivel plates 115 at its small radius end. Pin 117 is positioned through the support bracket 101 above the limit opening 113 so that the heavy end of the pair of swivel plates 115 will hang downwardly over the limit opening 113 when the base support bracket 101 is installed on the door jamb 103.

Bolt 109, is essentially a round bolt having a flattened surface at either end prohibiting its removal from the pair of swivel plates 115. The flattened surfaces of this bolt 109 may be created by a buildup of weld material, the welding of a flat plates, or the installation of a caps to both ends or the bolt 109 which act to stop the bolt 109 from sliding out beyond the swivel plates 115. The swivel plate bolt opening 113 is slightly larger than the midsectional diameter of the bolt 109 which enables the bolt 109 to slide back and forth through the swivel plates 115 to its end stops. With the swivel plates 115 in position on the support bracket 101, the weight of the bolt positions the swivel plates 115 in a downwardly most position with the bolt resting on the bottom of the limit opening 113.

An operating rod 119 is pivotably attached to the inside swivel plate 115, which is positioned on the side of the support bracket 101 away from the door 105, at a position between the bolt 109 and the pin 117. This operating rod extends longitudinally along the base support bracket 101 through a support bracket and guide clip 121 which is positioned on the base support bracket 101 at a location to support the operating rod while permitting the operating rod 119 to slightly pivot as the swivel plate 115 is pivoted about the pin 117. The outside swivel plate of course is carried along with the inside one.

A first electrode 123 is positioned on the support bracket and guide clip 121 facing away from the inside swivel plate 115. A first electrical wire 125 is connected to this first electrode.

A second electrode 127 is positioned at the end of the operating rod 119. This electrode may be supported by a support plate 129 attached to the end of the operating rod 119 and positioned to face the second electrode 127 towards the first electrode 123. An electrical wire 131 is connected to this second electrode.

The guide clip 121 is essentially a C-shaped plate having a cutout 133 in the center of one side whereby a pair of extension tabs 135 are defined. The guide clip 121 is joined to the base support bracket 101 by means of this pair of tabs 135. An opening or guide slot is therefore defined by the opening 133 through which the operating rod 119 may extend. The opening 133 will be rectangularly shaped when the operating rod 119 has a rectangular cross section and will be circularly shaped when the operating rod 119 has a circular cross section.

Figure 4:
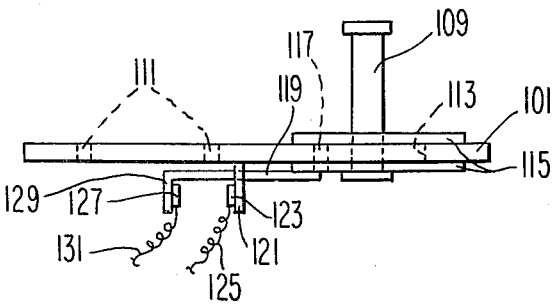
FIG. 4 is a top elevation of the apparatus shown in FIG. 2.

FIG. 4 shows the operational configuration for the assembly. It can be seen that as the bolt 109 is slid to the in-service position and the door is opened, the bolt 109 moves the pair of swivel plates 115, and the operating rod 119 is carried along moving the two electrodes 123 and 127 closer together. When the door moves a sufficient distance, the operating rod 119 closes the electrodes 123, 127 upon one another and the electrical switch comprised thereof is closed. An alarm which may be connected to the electrical wires 125, 131 is activated. When the bolt 109 and swivel plate 115 travel so that the bolt abutts the far wall of the limit opening 113 the bolt 109 is stopped from further movement, and the bolt 109 in combination with the support bracket 101 act as a positive limit to stop the door 105 from opening further. When the door 105 is closed, the forces of gravity operating upon the bolt 109 cause the swivel plates 115 to rotate back to their initial position with the bolt 109 resting upon the bottom of the limit opening 113 and against the fully closed door 105. The electrical contacts 123, 127 are broken and the alarm is deactivated.

This embodiment provides a very simple door alarm system which may be installed in new construction where the alarm mechanism may be located away from the door area. Typically, a door bell, siren, or bell mechanism may be placed anywhere within the building. A silent telephone alarm may also be electrically connected. Electrical connection is provided through the wall structure of the building.

Gravitational forces acting upon the bolt 109 will cause the pivot plate to fall to its rest position whenever the door is closed. The opening of the door 105 will push the bolt 109 upwardly and outwardly from the door jamb 103, little resistance to this movement being offered by the pivoting of the swivel plates 115 about the pin 117 or the sliding of the operating rod 119 against the opening 133 of the guide clip 121. To further reduce noise and friction the mating surfaces of the pin 117 and the guide clip 121 may be teflon coated or plastic lined. The only resistance to the opening of the door 105 which is offered by the alarm apparatus, therefore, is the force needed to pivot the swivel plates 115 and raise the operating rod 119 from its rest position to its elevated position against the far stop wall of the limit opening 113. Once the bolt 109 is in its far position limit opening 113 will positively stop the door from opening further.

The apparatus may predetermine the operational travel distance of the door 105 needed to cause an abutment with the limit opening and to close the electrical switch which mates the electrodes 123 and 127. This distance is a function of the longitudinal length of the support bracket 101, the depth at which support bracket is mounted in the door jamb 103, the location of the swivel plates 115 with respect to the limit opening 113 and the size and shape of the opening 113. Typically, it would be advantageous to adjust the apparatus so that the door 105 would not open beyond the far side of the door jamb 103 thus prohibiting a burglar from inserting a hacksaw or other cutting device usable to cut the alarm apparatus.

Figure 5:
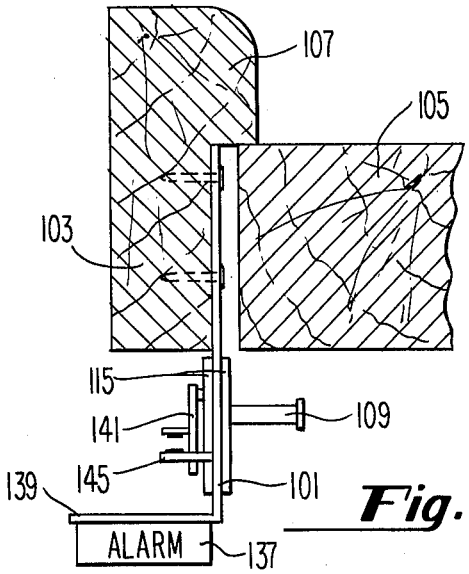
FIG. 5 shows the embodiment of the invention for installation with existing construction.
Figure 6:
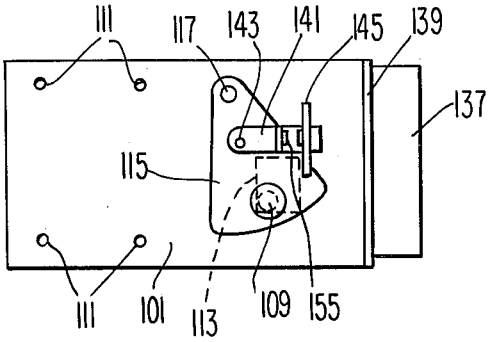
FIG. 6 shows a side view of the support bracket and associated swivel plate and electrical contact for the existing construction embodiment of FIG. 5.
Figure 3:
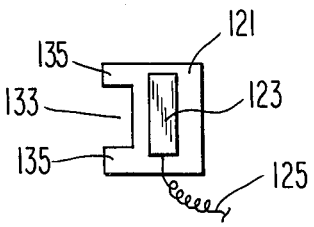
FIG. 3 shows in detail the support bracket and glide clip visable in FIG. 2.

An alternate configuration for the alarm apparatus is shown in FIG. 5 which configuration is adaptable to existing construction where it is difficult to cut through existing walls to connect the alarm. It differs from the new construction embodiment principally in that an alarm housing 137 is attached to the base support bracket 101 to provide a self contained unit. Base support 101, FIG. 6, is essentially of the same size, shape and dimensions as the base support bracket 101 of the first embodiment. An alarm 137 support plate 139 is formed at the end of the base support bracket 101 away from the door jamb 103, to extend from that end of the base support bracket 101 away from the swing arc of the door 105. Preferably, this alarm support plate 139 extends at a right angle to the base support bracket 101 and may be manufactured as an extension of this bracket which has been bent over 90°. The alarm 137 is mounted to the alarm support plate 139. This alarm 137 contains an audiosignaling apparatus and a battery supply for powering the audible alarm. Such an alarm apparatus may be made from any one of a plurality of commonly available components and can include a loud buzzer powered by a 9 volt long life battery, such buzzers commonly being utilized in smoke detectors, or a loud bell powered by the same type of battery.

The base support bracket 101 of the second embodiment includes the screw holes 111 which are positioned in approximately the same locations for holding the base support bracket 101 against the door jamb 103. Similarly, a pair of swivel plates 115 and a pivotal pin 117 are of similar structural configuration and are incorporated into this second embodiment.

A limit opening 113, of identical size and shape to the limit opening 113 of the first embodiment, extends through the base support bracket 101. A bolt 109 of identical size and shape to the first embodiment extends through the swivel plate 115 and the limit opening 113.

Figure 8:
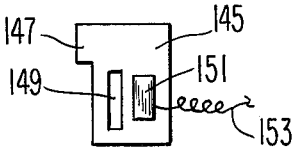
FIG. 8 is a detailed view of the support bracket of FIGS. 6 and 7.

An operating rod 141 is attached to the inside swivel plate 115 by a pin 143 which allows it to rotate slightly thereabout. The pin 143 connects to this inside swivel plate 115 on a side closer to the alarm support plate 139 and at a location between the pin 117 and the bolt 109. Operating rod 141 extends toward the alarm support plate 139 and is retained to a certain operating location by a support bracket and guide clip 145, FIG. 8.

Support bracket and guide clip 145 is essentially rectangularly shaped with a single extension tab 147 extending outwardly by which the clip is securely attached to the base support bracket 101. This clip may be soldered, welded or screwably mouned to the base support bracket 101 by means of the tab 147, the tab 147 being of a size to position the rectangular main structure of the support bracket and guide clip 145 away from the base support bracket 101 to allow a space for the inside swivel plate 115 to operate.

A guide hole 149 extends through the main portion of the guide clip 145. This hold 149 is of a size and shape to conform to the cross sectional configuration of the operating rod 141. And, in fact, holds the operating rod 141 in position to permit it to slide back and forth while pivoting slightly. Located on the side of the guide clip 145 facing away from the alarm support plate 139 is a first electrode 151 which has an electric wire 153 connected thereto.

The operating rod 141 is of a length which will permit it to be retained by the guide clip 145 and slide therethrough as the swivel plate 115 rotates thereabout due to forces put on the bolt 109 by the opening of the door 105.

Figure 7:
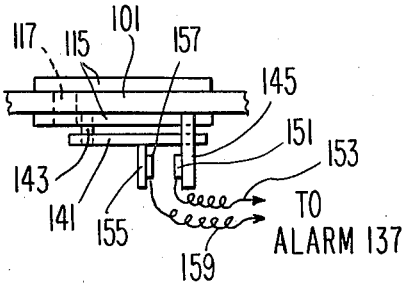
FIG. 7 shows in detail the structural interrelationship of the electrical contacts and support bracket of FIG. 6.

A small plate 155 is mounted on the operating rod 141 to hold a second electrode 157 which is connected to a second electrical wire 159, FIG. 7. The electrical wires 159 and 153 are connected to the alarm 137 by a length of coiled wires 153, 159 to permit unhampered operation of the operating rod 141. Electrodes 151 and 157 are positioned to face one another and find an electrical contact for activating the alarm 137. The electrodes 151, 157 may include an insulated base which electrically isolates them from their respective support members. Teflon or plastic lined guideways and pivot points may be incorporated as part of the overall design.

In operation this second embodiment works very much like the first. As the door 105 is opened, it presses against the bolt 109, in its inservice position, moving the bolt 109 outwardly from the door jamb 103 and upwardly. As this bolt moves the swivel plates 115 rotate and the operating rod 141 is slid through the clip 145 so that the electrodes 151 and 157 engage one another as the bolt 109 abutts the far side of the limit opening 113.

The electrodes 151 and 157 and their support members 145, 155 are positioned away from one another at a distance so that when the bolt 109 is moved within the limit opening 113 to the far stop electrical contact is simultaneously made by the mating of the two electrodes.

Functionally, therefore, the second embodiment operates exactly like the first embodiment. As the door 105 is opened and moved away from the door stop 107, the bolt 109 is engaged causing the swivel plate 115 to pivot about the pin 117 which moves the operating rod 141 carrying the movable electrode 157 toward the fixed electrode 151. As the bolt 109 abutts the far wall of the limit opening 113, the electrodes 151, 157 mate setting off the alarm 137. The bolt 109 resting against the limit opening 113 establishes a positive stop further prohibiting any opening of the door 105. The length of the operating rod 141, therefore the distance of travel between the electrodes 151 and 157, the pivotal arc described by the bolt 109, and the length of the base support bracket 101 in this embodiment, as in the first embodiment, act to define the distance which the door 105 is permitted to open before an absolute stop is reached. In most instances, it is desirable to limit the maximum opening of the door to a distance less than the width of the door jamp 103.

While the alarm system described herein is directed to the preferred embodiment and an alternate embodiment thereto, many changes and alternations can be made to the invention described without departing from the intent and scope thereof. It is intended, therefore, that this disclosure be taken in the illustrative sense and not in the limiting sense.

What is claimed:

1. A door burglar alarm for mounting to a door jamb comprising:

a bolt slidable into a position for intercepting the travel of said door;

means for supporting said bolt in proximity to said door jamb, said supporting means permitting movement of said bolt by said travel of said door, whereof said supporting means is mounted to said door jamb and wherein said supporting means includes a base support bracket capable of mounting to said door jamb and a swivel plate pivotally mounted to said base support bracket, said swivel plate being associated with said bolt;

means, associated with said supporting means and said bolt for initiating an alarm signal as a function of the relative position of said bolt with respect to said supporting means wherein said alarm signal initiating means, said supporting means and said bolt coacting with minimal friction; and means associated with said supporting means, for positively limiting the distance of travel of said bolt and therefore the travel of said door.

2. A door burglar alarm for mounting to a door jamb, comprising:

means for intercepting the travel of said door;

means for supporting said door intercepting means in proximity to said door jamb, said supporting means permitting movement of said intercepting means by said travel of said door, whereof said supporting means is mounted to said door jamb;

means, associated with said supporting means and said intercepting means for initiating an alarm signal as a function of the relative position of said intercepting means with respect to said supporting means, wherein said supporting means includes a base support bracket capable of mounting to said door jamb and a swivel plate pivotally mounted to said base support bracket, said swivel plate being associated with said intercepting means; and means, associated with said supporting means, for positively limiting the distance of travel of said intercepting means and therefore the travel of said door, wherein said limiting means includes an opening in said base support bracket through which said intercepting means operates, said opening defining the limits of operation for said intercepting means.

3. The alarm of claim 2 wherein said bolt is disposed through said limit opening, said bolt being slidably positionable to an inservice position where it is capable of intercepting the swing arc of said door and an out of service position where it is incapable of intercepting the swing arc of said door.

4. The alarm of claim 3 wherein said alarm signal initiating means includes means for making an electrical contact, said electrical contact means having an audible signal device electrically connected thereto and having a mechanical connection to said swivel plate.

5. The alarm of claim 4 wherein said swivel plate includes a hole disposed to receive said bolt; and wherein said bolt includes end caps at either end, said end caps acting to provide a stop of said bolt against said swivel plate to define the in service and out of service positions thereof.

6. The alarm of claim 5 wherein said electrical contact means includes:

an operating rod pivotally connected to said swivel plate;

a guide clip connected to said base support plate, said guide clip providing a guide way for said operating rod;

a first electrical contact mounted on said guide clip;

a second electrical contact mounted on said operating rod, said first and second electrical contacts being positioned to mate upon movement of said operting rod;

electrical wiring from said first and second contacts to said audible signal device.

7. The alarm of claim 6 wherein said audible signal device is disposed away from said door jamb vicinity.

8. The alarm of claim 6 also including an alarm support plate, said plate extending from said base support plate, generally away from the arc swing of said door.

9. The alarm of claim 8 wherein said audible signal device is mounted to said alarm support plate.

10. The alarm of claims 7 or 9 also including a Teflon lining on said guide clip, said guide way, said operating rod pivot point, and on said swivel plate pivot point.

* * * * *